US006073320A

United States Patent [19]

Salatin et al.

[11] Patent Number: 6,073,320

[45] Date of Patent: Jun. 13, 2000

[54] CASKET DISPLAY STRUCTURE

[75] Inventors: Randall S. Salatin, Greensburg, Ind.; Lajos L. Szabo, Jr., Columbus, Ohio

[73] Assignee: Batesville, Services, Inc., Batesville, Ind.

[21] Appl. No.: 08/905,683

[22] Filed: Aug. 1, 1997

[51] Int. Cl.[7] ..... A61G 17/00

[52] U.S. Cl. ..... 27/27; 211/85.16; 211/189; 40/606

[58] Field of Search ..... 27/27, 1; 403/335; 211/85.16, 189, 206; 52/797.1, 795.1, 481.2, 489.1; 40/606

[56] References Cited

U.S. PATENT DOCUMENTS

| | | | |
|---|---|---|---|
| 1,169,157 | 1/1916 | Honold | 211/85.16 X |
| 1,510,972 | 10/1924 | Beam | 211/85.16 |
| 1,841,412 | 1/1932 | Leicht | 27/27 X |
| 1,966,751 | 7/1934 | Brefeld | 211/85.16 |
| 3,532,317 | 10/1970 | Adler | 40/606 X |
| 4,669,157 | 6/1987 | Schwarten | 27/1 |
| 4,785,946 | 11/1988 | Sorensen | 211/189 X |
| 5,405,017 | 4/1995 | Szabo, Sr. et al. . | |
| 5,524,394 | 6/1996 | Szabo, Sr. et al. . | |
| 5,535,898 | 7/1996 | Burgess, Sr. et al. | 411/206 |
| 5,607,070 | 3/1997 | Hellyer | 211/189 |
| 5,694,881 | 12/1997 | Creech | 40/606 X |
| 5,797,499 | 8/1998 | Pinco . | |

*Primary Examiner*—Brian K. Green
*Assistant Examiner*—William L. Miller
*Attorney, Agent, or Firm*—Wood, Herron & Evans, L.L.P.

[57] ABSTRACT

A casket display structure has a floor-supported casket support adapted to support and display a casket. At least one standard is connected to and extends upwardly from the casket support. A decorative panel is hung on the standard. A rearward facing decorative panel may also be hung on the standard. In that case a second casket support may be positioned on an opposite side of the decorative panels from the first casket support. Two such casket display structures may be positioned perpendicularly to one another with the side edge of the second display structure abutting the rearward facing decorative panel of the first display structure. By utilizing three two-tiered casket racks in such an arrangement, a total of six caskets can be displayed.

7 Claims, 5 Drawing Sheets

CASKET DISPLAY STRUCTURE

FIELD OF THE INVENTION

This invention relates generally to the funeral service industry, and more particularly to a casket display structure for displaying caskets for selection by a customer of a funeral home.

BACKGROUND OF THE INVENTION

Funeral home casket selection rooms have evolved as those in the industry have attempted to better meet the funeral customers' needs. The "traditional" presentation of product in a funeral home selection room was to simply place each casket on a bier and open the head end cap or lid of the casket to permit viewing inside the casket. As many caskets as possible were displayed in a selection room in order to maximize the number of product choices for the customer. Unfortunately, such a "traditional" presentation results in what has been referred to as a "sea of caskets" effect, which can be both distressing or alarming and confusing to the customer.

Advances in the design of funeral home selection rooms have taken the form of providing a plurality of alcove structures, either of a "modular" construction or of a "stick built" construction, in the funeral home selection room. Each alcove structure includes a vertical back wall and a pair of vertical, spaced apart wing walls cooperating with the back wall to form an alcove. A soffit may span the upper front edges of the wing walls, and lighting, for example track lighting, may be incorporated into the soffit. A two-tiered casket rack is located within the alcove, the lower tier of the casket rack being a roll out rack permitting the lower casket to be rolled out from under the upper casket and the casket lid opened for display of the lower casket. Tasteful signage and the like is mounted on the back wall above the caskets. Such a construction, which is the subject of the assignee's prior U.S. Pat. Nos. 5,405,017 and 5,524,394, both increases the number of caskets which can be displayed in a funeral home selection room, as well as greatly improves the "look and feel" of the casket presentations, reducing the clutter and confusion of the so-called "sea of caskets" effect and providing a feeling of comfort to the families. U.S. Pat. Nos. 5,405,017 and 5,524,394 are hereby incorporated by reference herein at this point as if fully set forth in their entirety.

New construction and renovation costs being what they are, there is an ever-increasing need to provide more economical casket display structures. In particular, there is a need to provide economical casket display structures which permit a high product density to be displayed in a funeral home selection room, yet which do not sacrifice the convenience and look and feel of the casket display systems of U.S. Pat. Nos. 5,405,017 and 5,524,394. Further, there is a need to provide such casket display structures which may be quickly assembled and moved to arrange in the first instance, or to rearrange, a selection room.

SUMMARY OF THE INVENTION

Accordingly, the present invention provides a casket display structure for displaying caskets for selection by a customer of the funeral home. The casket display structure of the present invention is economical to manufacture, can be quickly assembled, and may be readily moved about the selection room depending on the arrangement of display structures desired for the selection room. The casket display structure of the present invention compromises a floor-supported casket support adapted to support and display a casket, at least one standard connected to and extending upwardly from the casket support and signage hung on the standard.

In another aspect, the present invention provides a casket display structure comprising a floor-supported casket support adapted to support and display a casket, at least one standard connected to and extending upwardly from the casket support, forward facing signage hung on the standard, and rearward facing signage also hung on the standard.

In yet another aspect, the present invention provides a casket display structure comprising a first floor-supported casket support adapted to support and display a casket, at least one standard connected to and extending upwardly from the first casket support, a forward facing decorative panel hung on the standard, a rearward facing decorative panel also hung on the standard, and a second floor-supported casket support also adapted to support and display a casket. The second casket support is positioned on an opposite side of the decorative panels from the first casket support.

In still another aspect, the present invention provides an arrangement of casket display structures. In the arrangement, each of the casket display structures comprises a floor-supported casket support adapted to support and display a casket, at least one standard connected to and extending upwardly from the casket support, a forward facing decorative panel hung on the standard and a rearward facing decorative panel hung on the standard. The arrangement comprises a first such casket display structure, and a second such casket display structure positioned perpendicular to the first such casket display structure. The forward and rearward facing decorative panels of the second casket display structure each have opposed side edges. The respective side edges of the forward and rearward facing decorative panels of one side of the second casket display structure abut the rearward facing decorative panel of the first casket display structure.

The casket display structure of the present invention provides a number of additional features. The signage may be a decorative panel, a category sign or both. The casket display structure may include a pair of vertical standards, which are connected together at their upper ends with a horizontal connecting member. Each of the pair of standards includes a hanger bracket mounted thereon near an upper end thereof. Each hanger bracket includes a pair of hooks thereon. The decorative panel and the category sign each include a block on a back side thereof. The blocks cooperate with the hooks to hang the decorative panel and the category sign on the brackets and therefore on the standards. The blocks have a lower beveled edge which is angled to match the angle of the hooks from vertical, and preferably less than 90 degrees from the vertical.

The casket support may be a two-tiered casket rack having an upper section adapted to support and display an upper casket and a lower section adapted to support and display a lower casket. In a preferred embodiment, the casket support is a two-tiered casket rack having a floor-supported base, a vertical section extending upwardly from a rear edge of the base, an upper horizontal section extending forwardly from an upper edge of the vertical section and adapted to support and display an upper casket, and a lower horizontal floor-supported rollout section adapted to support and display a lower casket.

In the embodiment of the casket display structure of the present invention which includes forward and rearward facing signage, a hanger bracket is mounted on each of the forward and rearward facing sides of each of the standards near an upper end thereof. Each hanger bracket includes a pair of hooks thereon. In this manner, the blocks mounted on the back sides of one set of the decorative panel and category sign may be hung on the hooks on the forward facing side of the standards, and the blocks on the back sides of the other set of the decorative panel and category sign may be hung on the hooks of the hanger brackets mounted on the rearward facing side of the standards.

In this embodiment, the forward and rearward facing decorative panels each have opposed side edges. The display structure of this embodiment may further comprise a laterally facing decorative panel on each lateral side of the display structure. Each laterally facing decorative panel covers the corresponding side edges of the forward and rearward facing decorative panels. As mentioned above, the forward and rearward facing decorative panels each include a block on the back side thereof. A bracket is secured to the blocks of the forward and rearward facing panels at each lateral end. The bracket has an upwardly directed tongue. Each laterally facing decorative panel includes a bracket secured thereto on the back side thereof having a downwardly directed tongue. The laterally facing decorative panels are removably secured to the forward and rearward facing decorative panels by removable engagement of the tongues of the brackets on the laterally facing decorative panels with the tongues of the brackets on the blocks of the forward and rearward facing decorative panels.

The present invention therefore provides a casket display structure which may be economically manufactured and quickly assembled. Furthermore, the casket display structure of the present invention admits of several different arrangements in a funeral home selection room.

These and other advantages of the present invention will become more readily apparent during the following detailed description taken in conjunction with the drawings herein, in which:

DETAILED DESCRIPTION OF THE INVENTION

Figure 1:
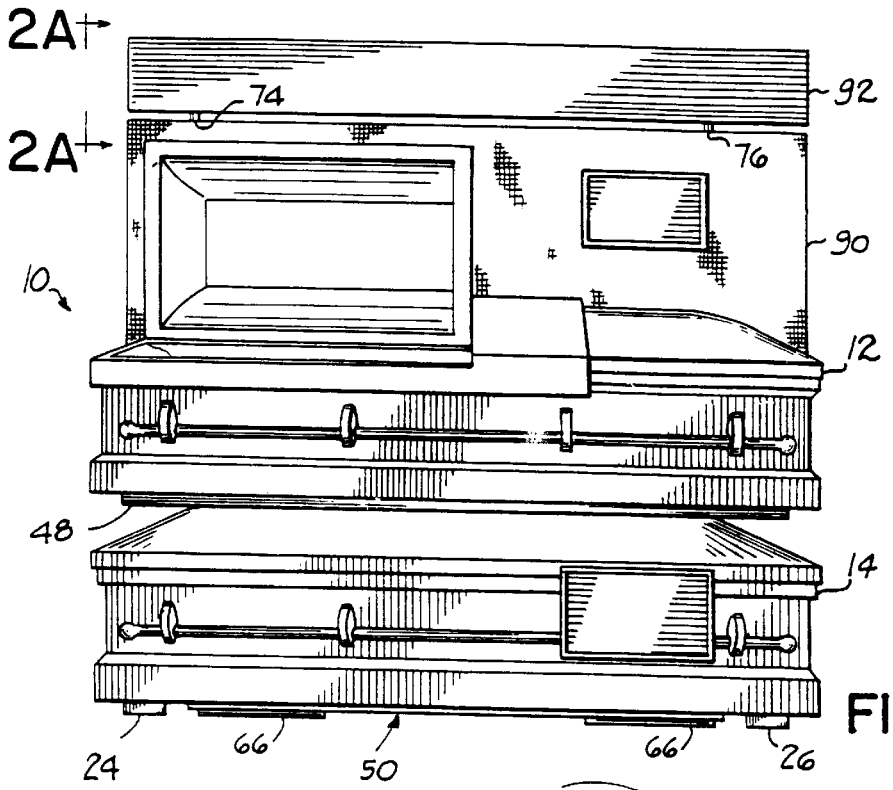
FIG. 1 is a front perspective view of the casket display structure of the present invention.
Figure 3:
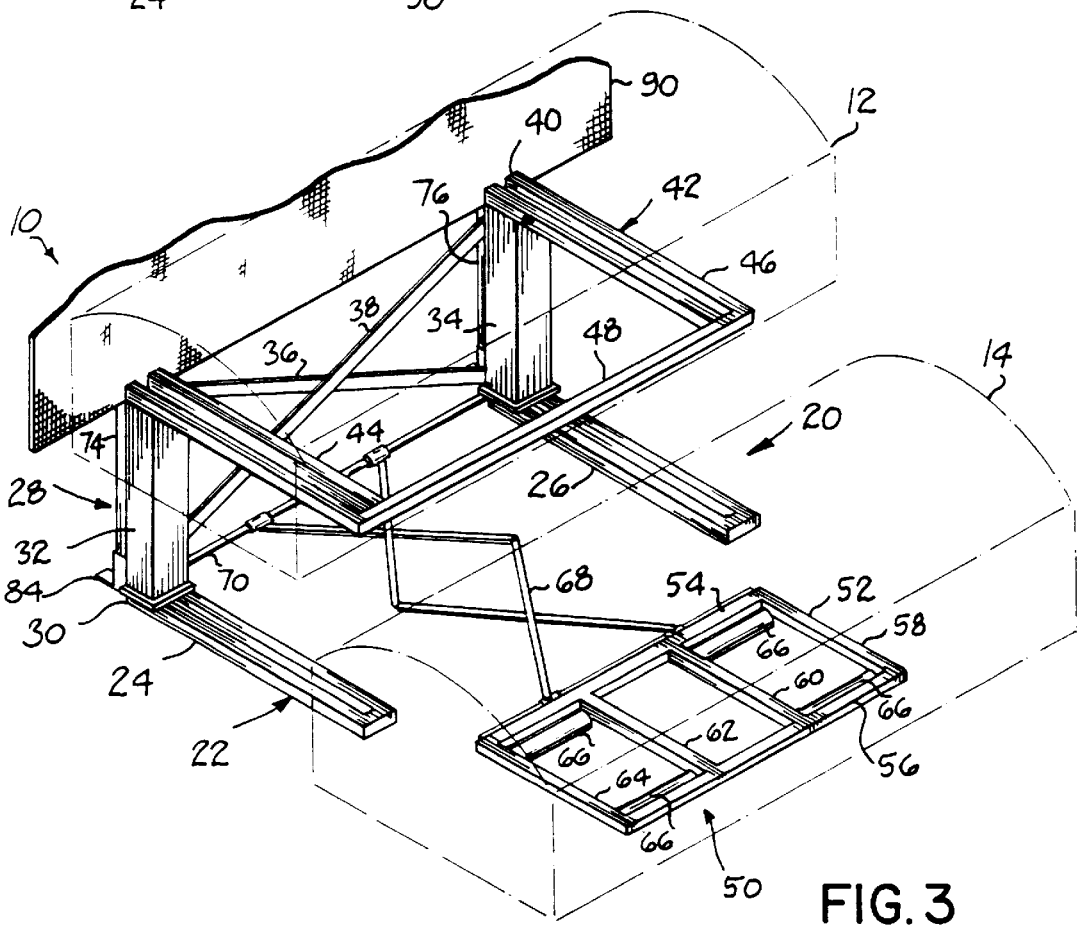
FIG. 3 is a partial perspective view of the lower portion of the casket display structure of FIG. 1 illustrating the two-tiered casket rack with the bottom rack rolled out from under the upper rack to permit opening of the lid of the lower casket and viewing therein.
Figure 2:
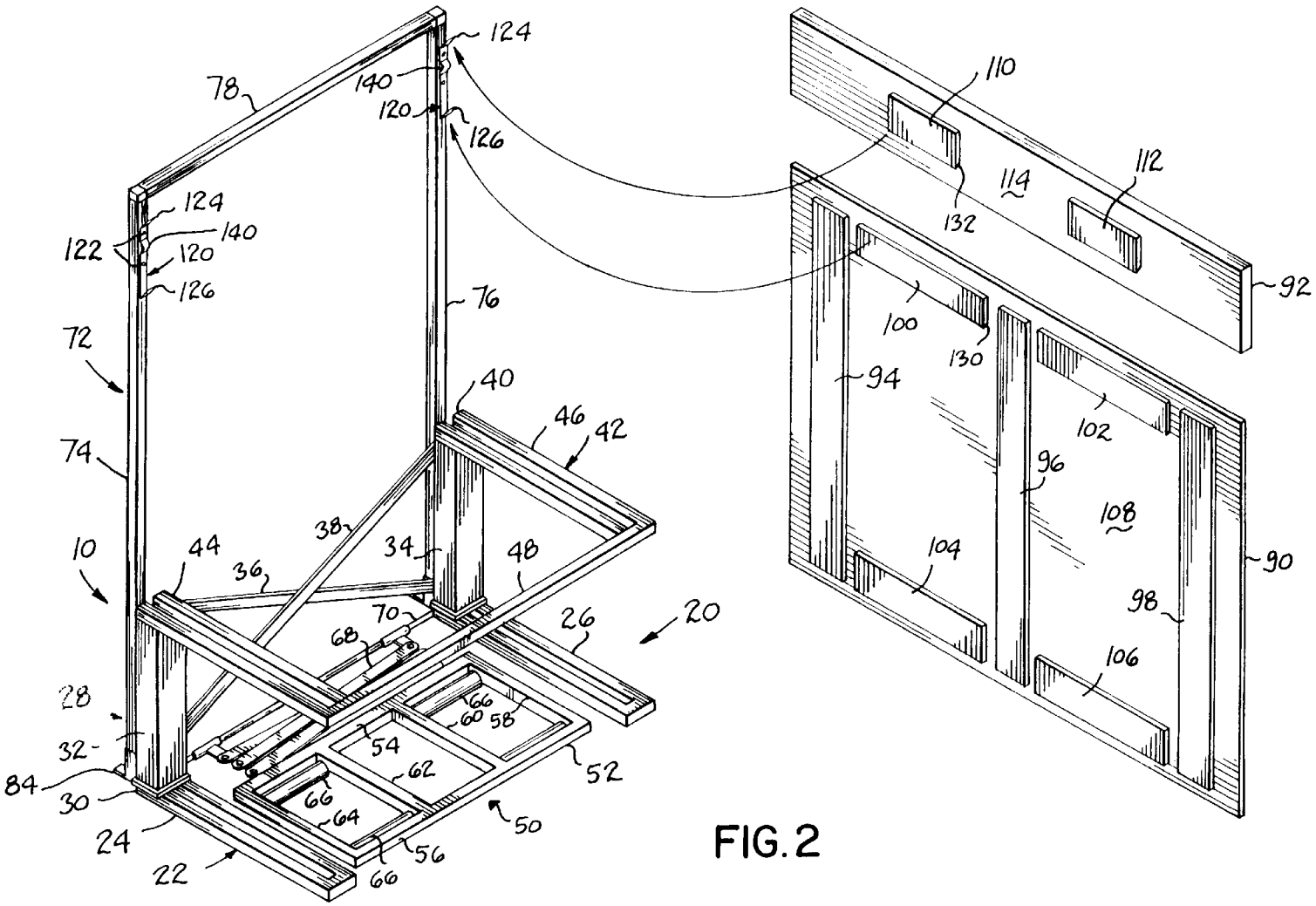
FIG. 2 is an exploded perspective view of the casket display structure of FIG. 1 illustrating the attachment of the decorative panel and category sign to the vertical standards.

Referring first to FIGS. 1–3, there is illustrated a casket display structure 10 according to the principles of the present invention. The casket display structure 10 is adapted to support and display an upper casket 12 and a lower casket 14 (phantom).

The casket display structure 10 of this invention includes a floor-supported casket support 20. The support 20 is a two-tiered steel casket rack having a floor-supported base 22 comprising feet 24 and 26. A vertical section 28 extends upwardly from a rear edge 30 of the base 20. This vertical section 28 comprises upright members 32 and 34, which are interconnected by cross braces 36 and 38 for stability. Extending forwardly from an upper edge 40 of the vertical section 28 is an upper horizontal section 42 adapted to support and display upper casket 12. Horizontal section 42 comprises forwardly projecting arms 44 and 46 interconnected by a connecting member 48 at the forward edges of arms 44 and 46. The casket support structure 20 further includes a lower horizontal section 50 adapted to support and display lower casket 14. Lower horizontal section 50 is floor-supported and comprises a rollout floor-supported frame 52 having elongated side members 54 and 56 interconnected by transverse members 58, 60, 62 and 64. Four rollers 66 are mounted to the frame 52 at the corners thereof to provide for smoothly rolling the lower casket 14 out from under the upper casket 12. A scissors mechanism 68 connects the frame 52 to a transverse member 70 connected to and spanning between the members 32 and 34 of rear vertical section 28. The support 20 is of the type described in U.S. Pat. Nos. 5,405,017 and 5,524,394 which were incorporated by reference above. The support 20 is designed to present the caskets 12 and 14 as appearing to "float" in the air, thereby making the caskets themselves the focus rather than the supporting structure which supports the caskets.

Referring now to FIGS. 1–4, an upright frame 72 is secured to the vertical section 28 of the support 20. Upright frame 72 comprises a pair of vertical standards 74 and 76 interconnected at their upper ends via a horizontal connecting member 78. Bolts 80 and 82 connect the lower ends of the standards 74 and 76 to the upright members 32 and 34 of the vertical section 28. A foot 84 is positioned at the lower end of each of the standards 74 and 76. This foot preferably extends below the lower surface of the feet 24 and 26 at the base 22 by about ⅛ of an inch to tilt the display structure 10 slightly forwardly. The frame 72 is preferably constructed of 1" square steel tubing, 16 guage.

Figure 2A:
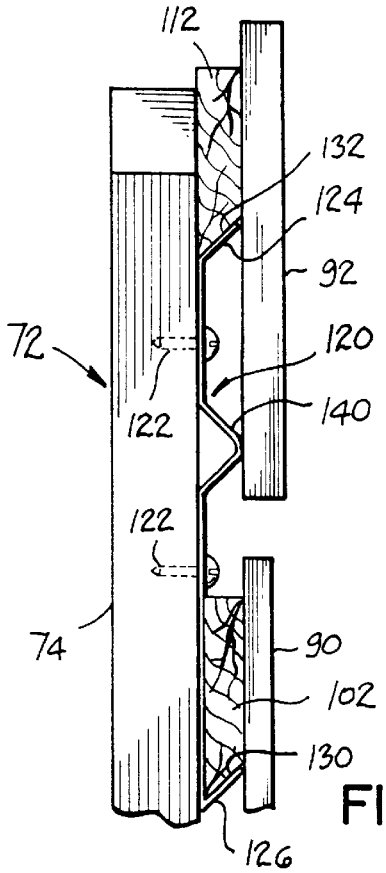
FIG. 2A is a view taken along line 2A—2A of FIG. 1.

Referring now to FIGS. 2 and 2A, signage in the form of a decorative panel 90 and a category sign 92 is illustrated as being removably securable to the standards 74 and 76 of the frame 72. Decorative panel 90 forms the general background of the caskets displayed and may include any decorative surface treatment as is desired; category sign 92 positioned above the decorative panel 90 may include indicia (not shown) indicating the category of the casket displayed, e.g. wood, metal or the like. As used herein, the term "signage" is used to generically embrace both decorative panels and category signs, as well as any other type of sign, display board, placard, marker, indicator or similar device used for decorative purposes and/or to convey information, that may be secured to the standards 74 and 76.

The decorative panel 90 includes vertical wooden blocks 94, 96 and 98, upper horizontal blocks 100 and 102, and lower horizontal blocks 104 and 106 secured to a back side 108 thereof. Similarly, category sign 92 includes horizontal blocks 110 and 112 secured to a back side 114 thereof. A hanger bracket 120 is secured to the upper end of each of the standards 74 and 76 with sheet metal screws 122. Each hanger bracket includes an upper upwardly angled or directed hook or tang 124 and a lower upwardly directed or angled hook or tang 126. The block 102 on the back side of the decorative panel 90 includes a lower edge 130 beveled to mate with the angle of the lower hook 126. Similarly, the block 112 on the back side of the category sign 92 includes a lower edge 132 beveled to match the angle of the upper hook 124 on the hanger bracket 120. Thus, the decorative panel 90 and category sign 92 may be removably secured to the hanger bracket 120 thereby hanging the same on the standards 74 and 76. Hanger bracket 120 further includes a bend 140 stamped therein to act upon the lower end of the back side of the category sign 92 to maintain same in a vertical orientation. The decorative panel 90 and category sign 92 are of the type described in U.S. Pat. Nos. 5,405,017 and 5,524,394 which were incorporated by reference above.

Figure 7:
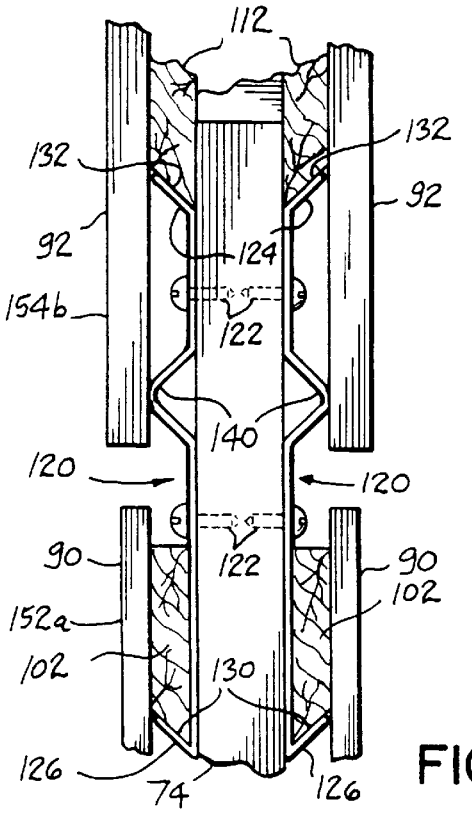
FIG. 7 is a view similar to FIG. 2A but illustrating the FIG. 5 embodiment of the present invention which includes forward and rearward facing category signs and decorative panels.
Figure 4:
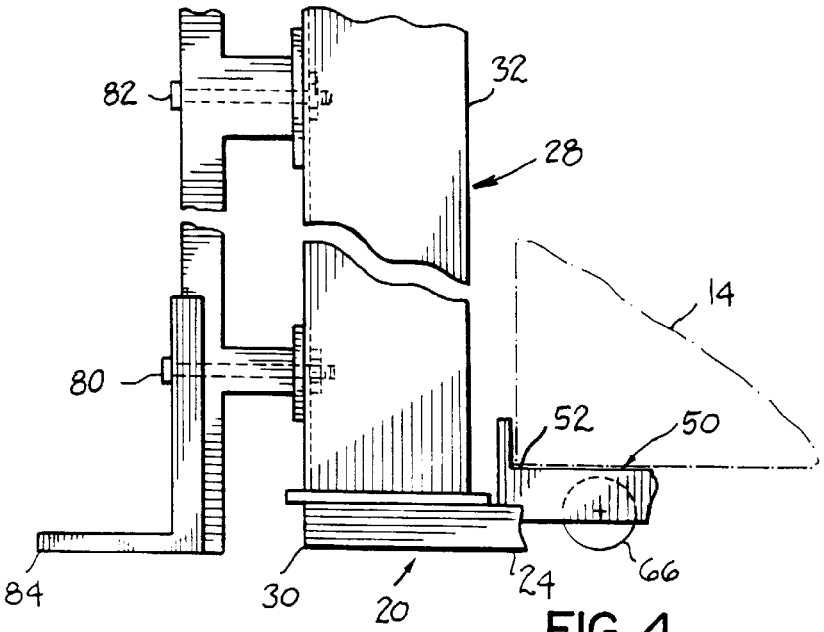
FIG. 4 is a partial side elevational view of the lower portion of the casket display structure of the present invention illustrating the attachment of the vertical standards to the two-tiered casket rack.
Figure 6:
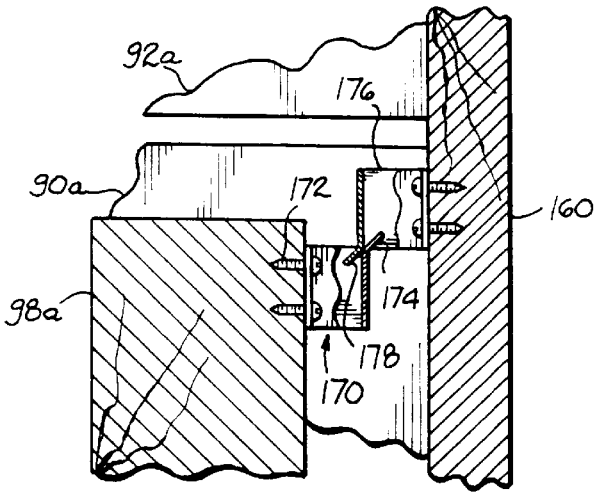
FIG. 6 is a view taken along line 6—6 of FIG. 5.
Figure 5:
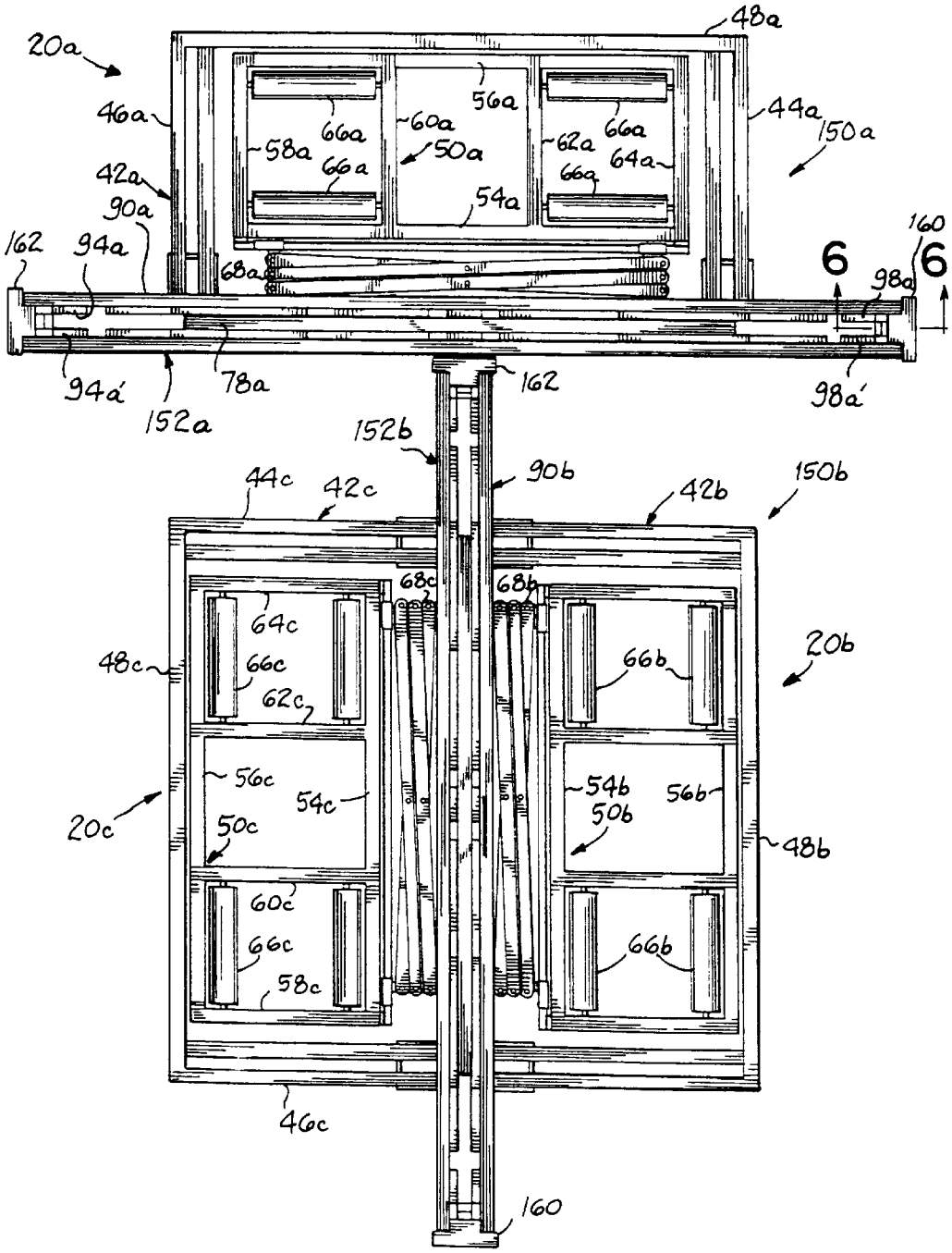
FIG. 5 is a top plan view of an arrangement of two casket display structures which are of an alternative embodiment with each including forward and rearward facing decorative panels.

Referring now to FIGS. 5, 6 and 7, there is illustrated an alternative embodiment of the casket display structure of the present invention. Referring first to FIG. 5, two such alternative embodiments 150*a* and 150*b* are arranged in an island, and more specifically in a generally "T" configuration. Like element numerals designate like components from the FIGS. 1–4 embodiment; the suffix "a" has been added to the element numerals of structure 150*a* and the suffix "b" has been added to the element numerals of the structure 150*b* for clarity. Each display structure 150*a* and 150*b* is identical to that of FIGS. 1–4 except that, in addition to having forward facing decorative panels 90*a* and 90*b*, respectively, the displays also have rearward facing decorative panels 152*a* and 152*b*, respectively. A third two-tiered casket support 20*c*, identical to the two-tiered supports 20*a* and 20*b*, is simply placed on the opposite side of the decorative panels 90*b*, 152*b* from the support 20*b*. Like element numerals also designate like components of the prior described casket support 20; the suffix "c" has been added to the element numerals of support 20*c* for clarity. In this manner, the rearward facing decorative panel 152*b* forms the background for the third two-tiered casket support 20*c*, and the other rearward facing decorative panel 152*a* forms the background for both casket supports 20*b*, 20*c*. In this manner, six caskets may be displayed with this arrangement, with all of the caskets having a tasteful background. Referring to FIG. 7, it will be seen that an additional hanger bracket 120, on the rearward facing side of the standards 74, 76, is employed to hang the rearward facing decorative panel 152*a* and rearward facing category sign 154*a*. It is contemplated that the two brackets could be combined into a single piece of hardware and still be within the scope of the invention.

Figure 6A:
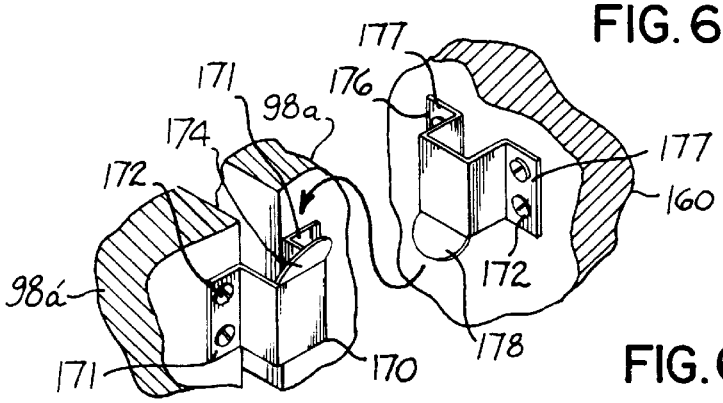
FIG. 6A is an exploded perspective view of the brackets which are for removably securing laterally facing panels over the side edges of the display structure.

Referring now to FIGS. 6 and 6A, in conjunction with FIG. 5, it will be seen that the alternative embodiment casket display structures 150*a* and 150*b* each include laterally facing and opposed decorative panels 160 and 162. As illustrated, the laterally facing decorative panels 160 and 162 cover the corresponding side edges of the forward and rearward facing decorative panels 90*a* and 152*a*, respectively, and the corresponding side edges of the forward and rearward facing category signs (only the forward facing category sign 92*a* is shown; see FIG. 6A) thus presenting a clean, finished appearance. A generally U-shaped bracket 170 has a pair of flanges 171 each of which is attached to one of the blocks 98*a*, 98*a*' (mounted to the back sides of decorative panels 90*a* and 152*a*) via screws 172. A similar bracket 176 has its flanges 177 mounted on the back side of the laterally facing decorative panel 160 via screws 172 and similarly includes a downwardly directed tongue 178. The laterally facing decorative panels 160 and 162 are removably secured to the forward and rearward facing decorative panels 90*a*, 152*a* by removable engagement of the tongues 174 and 178. Preferably three such bracket 170 and 176 combinations are used to hang each laterally facing panel 160, 162 from the decorative panels 90*a* and 152*a*.

In use, the standards 74 and 76 are bolted to the members 32 and 34 of the casket support 20, which itself has been pre-assembled. The upper ends of the standards 74 and 76 are interconnected via the interconnecting number 78 with, for example, telescoping plastic right angle end caps or the like. Hanger brackets 120 are then mounted to the upper ends of the standards 74 and 76, on just the forward facing side if the casket display structure is to be of the first embodiment described above, and on both forward and rearward facing sides if the casket display structure is to be of the latter alternative embodiment described above. Once the brackets are attached, the category sign(s) 92 and decorative panel(s) 90 are removably secured to the standards 74 and 76 by placing the blocks 110, 112, 100 and 102, respectively, on the upper and lower hooks 124 and 130, respectively. If the casket display is to be of the alternative embodiment type, then an additional category sign and decorative panel are identically mounted on the back or rearward facing side of the standards 74 and 76. In that case, brackets 170 are secured to the lateral ends of the blocks 98 on the back sides of the decorative panels 90. The similar brackets 176 are secured to the back sides of the laterally facing decorative panels 160 and 162, and the respective tongues 174, 178 are interengaged to hang the panels 160 and 162 from the panels 90.

In the event that a casket display structure arrangement according to FIG. 5 is desired, one needs simply to construct two such casket display structures of the alternative embodiment as described above, and then orient the second one perpendicularly to the first one, the lateral edges of the category signs and decorative panels of the second such display structure abutting the rearward facing decorative panel of the first such display structure. A third two-tiered casket support 20 is then positioned to be adjacent the vertical portion of the "T" of the casket arrangement, i.e. "behind" the second casket display structure, or on the opposite side of the decorative panels as is the casket support 20 of the second display structure. These two casket display structures may be interconnected for stability by, for example, passing a bolt through holes in the criss-cross braces 36, 38 at their points of intersection and securing the same with a nut thereon. The caskets may then be placed on the two tiers of the casket rack.

The casket display structure of this invention therefore provides an economical alternative for those funeral homes which do not wish to invest in either stick built or modular alcove casket displays. The casket display structure of this invention is "self-supporting" in that the casket support 20 carries the background decorative panel as well as the informational category sign. A separate floor-supported back wall, whether of the modular type or that of an existing room wall, is thus not required to mount the decorative panel and category sign. Casket display structures of this invention may be arranged along a wall or in island groups. The simplicity in design of this casket display structure allows one to assemble the display structure using only a socket wrench in less than 30 minutes. The modular design of this casket display structure permits easy adaptation to changes in the arrangement of the selection room. The two-tiered casket support effectively increases the display space of the funeral home, and the floating design of the two-tiered casket support permits excellent viewing of the caskets' detailing. The background panels and category signs focus the customer's attention and eliminate distractions yet without sacrificing the comforting look and feel of prior alcove casket displays.

Those skilled in the art will readily recognize numerous adaptations and modifications which can be made to the present invention which will result in an improved casket display structure, yet all of which will fall within the spirit and scope of the present invention as defined in the following claims. Accordingly, the invention is to be limited only by the scope of the following claims and their equivalents.

What is claimed is:

1. A casket display structure comprising:

a floor-supported casket support adapted to support and display a casket;

at least one standard connected to and extending upwardly from said casket support;

forward facing signage hung on said at least one standard; and rearward facing signage hung on said at least one standard;

wherein said forward and rearward facing signage each has opposed side edges, and said display structure further comprises a laterally facing decorative panel on each lateral side of said display structure, each said laterally facing decorative panel covering the corresponding side edges of said forward and rearward facing signage.

2. The casket display structure of claim 1 wherein a bracket having an upwardly directed tongue is secured to at least one of said forward and rearward signage at each lateral side thereof, and each said laterally facing decorative panel includes a bracket secured thereto on a back side thereof having a downwardly directed tongue, said laterally facing decorative panels being removably secured to said display structure by removable engagement of said tongues of said brackets on said laterally facing decorative panels with said tongues of said brackets on said at least one of said forward and rearward facing signage.

3. The casket display of claim 2 wherein said forward and rearward facing signage comprises forward and rearward facing decorative panels, respectively.

4. The casket display structure of claim 3 wherein each of said forward and rearward facing decorative panels includes a block mounted on a back side thereof, and each said signage bracket is secured to corresponding lateral ends of said decorative panel blocks.

5. The casket display structure of claim 4 wherein all said brackets are U-shaped and include a pair of outwardly directed mounting flanges.

6. A casket display structure comprising:

a first floor-supported casket support adapted to support and display a casket;

at least one standard connected to and extending upwardly from said first casket support;

a forward facing decorative panel hung on a first side of said at least one standard;

a rearward facing decorative panel hung on a second side of said at least one standard; and a second floor-supported casket support adapted to support and display a casket, said first casket support positioned on said first side of said at least one standard, said second casket support positioned on said second side of said at least one standard;

wherein said forward and rearward facing decorative panels each have opposed side edges, and said display structure further comprises a laterally facing decorative panel on each lateral side of said display structure, each said laterally facing decorative panel covering the corresponding side edges of said forward and rearward facing decorative panels.

7. An arrangement of casket display structures, each said casket display structure comprising a floor-supported casket support adapted to support and display a casket, at least one standard connected to and extending upwardly from said casket support, a forward facing decorative panel hung on a first side of said at least one standard and a rearward facing decorative panel hung on a second side of said at least one standard, said arrangement comprising:

a first said casket display structure; and a second said casket display structure positioned perpendicular to said first casket display structure, said forward and rearward facing decorative panels of said second casket display structure each having opposed side edges, the respective side edges of said forward and rearward facing decorative panels of one side of said second casket display structure abutting said rearward facing decorative panel of said first casket display structure;

wherein said forward and rearward facing decorative panels of each said casket display structure have opposed side edges, and each said forward and rearward facing decorative panels each have opposed side edges, and said display structure further comprises a laterally facing decorative panel on each lateral side of said display structure, each said laterally facing decorative panel covering the corresponding side edges of said forward and rearward facing decorative panels.

* * * * *